United States Patent [19]

Hirai et al.

[11] 4,245,137

[45] Jan. 13, 1981

[54] MULTI-FUNCTION ELECTRICAL CONTROLLING DEVICE

[75] Inventors: Akiyoshi Hirai; Yasuo Hagisato, both of Toyota, Japan

[73] Assignee: Toyota Jidosha Kogyo Kabushiki Kaisha, Toyota, Japan

[21] Appl. No.: 24,258

[22] Filed: Mar. 27, 1979

[30] Foreign Application Priority Data

Aug. 8, 1978 [JP] Japan ..... 53-96533

[51] Int. Cl.[3] ..... H01H 9/24; H01H 3/46

[52] U.S. Cl. ..... 200/4; 200/6 A; 200/18

[58] Field of Search ..... 307/139; 200/1 V, 4, 200/6 A, 18

[56] References Cited

U.S. PATENT DOCUMENTS

| | | | |
|---|---|---|---|
| 3,303,403 | 2/1967 | Bonanno | 200/4 |
| 3,731,013 | 5/1973 | Nightengale | 200/4 |
| 4,164,633 | 8/1979 | Sheridan | 200/4 |

*Primary Examiner*—Richard A. Wintercorn
*Assistant Examiner*—S. D. Schreyer
*Attorney, Agent, or Firm*—Finnegan, Henderson, Farabow, Garrett & Dunner

[57] ABSTRACT

An electrical controlling device with a single actuating lever, which may be either twisted about its long axis to activate a first electrical controlling means, or tilted about at least one tilt axis perpendicular to its long axis in order to activate a second electrical controlling means.

6 Claims, 5 Drawing Figures

MULTI-FUNCTION ELECTRICAL CONTROLLING DEVICE

BACKGROUND OF THE INVENTION

The present invention relates to an electrical controlling device, and, more particularly, to a multi-function electrical controlling device with a single actuating lever.

In the prior art it is well known to provide an electrical controlling device with an actuating lever which is adapted, for instance, to control switching of a variety of circuits as the lever is moved in the up-and-down, or the left-and-right, directions. Such devices are used, for instance, to control the operation of power-operated remote-control mirrors in automobiles. In this case, the power-operated remote-control mirror may be provided with a motor which can be operated in the one direction or the other as the D.C. voltage supplied to it is of the one or the other polarity, and which moves the mirror up and down when a solenoid in an electromagnetic clutch is energized, but which moves the mirror left and right when the solenoid is not energized. Therefore when a control switch has a lever which can be moved in the up-and-down and the right-and-left modes, this switch can control the motor and the solenoid at the same time, so that a mirror is adjusted in both the up-and-down and the left-and-right positions by operation of a single lever.

However, when several similar objects have to be controlled, as in the case of mirrors in automobiles, complications have arisen. It has been necessary to provide a plurality of controlling switches to correspond to the plurality of objects to be controlled. In the above example, with a vehicle which has two exterior mirrors, for instance, it has been necessary to provide two separate switches, one for controlling each of the mirrors. Therefore, the vehicle operator must first select which switch to use, and then adjust the mirror by using that switch.

Such problems further, are aggravated in the case that more than two similar devices need to be controlled in the same way.

In general, in a control device which has one lever which the operator may grip to operate the device, use has heretofore been made of movement of the end of the lever in both of the up-and-down and the left-to-right directions. Further, it is well known to use a control knob which is adapted to be twisted about its central axis for operation. However, movement in the twisting sense, where the lever is twisted so as to rotate about its long axis, has not been heretofore used in combination with the aforesaid two other movements. Theoretically, rotational movement of a body can be expressed by the rotations about three independent axes of rotation, and therefore if two of these three axes of rotation are to be used for the up-to-down and the left-to-right movement of a switching element, the rotation about the third axis should provide the maximum possible number of control functions theoretically available.

SUMMARY OF THE INVENTION

Therefore, it is an object of the present invention to provide a compact multi-functioning electric control device, with which, by manipulating a single actuating lever, it is possible to perform any of three independent control functions, by moving the end of the lever up-and-down, by moving the end of the lever left-and-right, and by twisting the end of the lever.

It is a further object of the present invention to provide a multi-functioning control device of the above-mentioned kind in which two of these three control functions are combined as a control function actuated by both sidewise and up-and-down movement of the end of the lever, of a two-way kind, the control function exercised by the twisting of the lever being independent.

It is a further object of the present invention to provide a device of the above mentioned second kind in which the twisting operation of the end of the lever about the long axis of the lever actuates a switching means which modifies the operation of the other two control functions by switching their operation between a plurality of controlled devices.

In accordance with the present invention, the above-mentioned and other objects of the invention are attained by an electrical controlling device, comprising: a housing; an actuating lever movably coupled to the housing and having its outer end projecting therefrom and adapted to be gripped at this outer end by the hand of an operator, which may be moved relative to the housing in a mode of twisting rotation about its long axis and in a mode of tilting rotation about at least one tilt axis which intersects in the housing the long axis of the lever; a first electrical controlling means actuated by said twisting of the lever; and a second electrical control means actuated by said tilting of the lever about the tilt axis.

BRIEF DESCRIPTION OF THE DRAWINGS

Other objects and features of the present invention will become more clear when the following description of a preferred embodiment is taken in conjunction with the accompanying drawings. However, neither the preferred embodiment, nor the drawings, should be taken as limitative of the scope of the protection sought for the present invention, which scope is intended to be defined solely by the appended claims. The embodiment, and the appended drawings, are given for the purposes of illustration only. In the drawings:

DESCRIPTION OF THE PREFERRED EMBODIMENT

Figure 1:
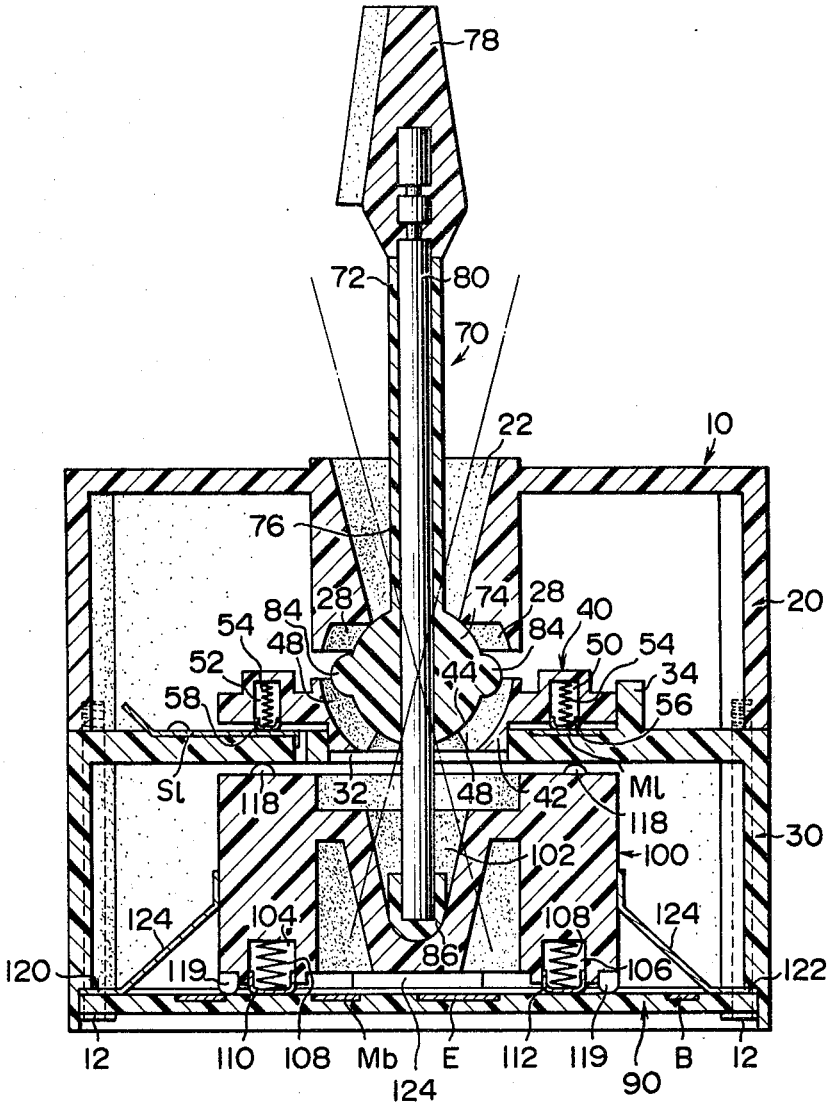
FIG. 1 is a vertical sectional view of a control switching device of the present invention, which is particularly adapted to control two powered exterior mirrors of an automobile.

The control switching device 10 in accordance with the present invention comprises upper and lower box-like housings 20 and 30 which are formed of electrically insulating material such as synthetic resin. These housings each has a top and four side walls, and they are each open at the bottom. The housings are, as best shown in FIG. 1, coupled one over the other at their four corners by bolts 12.

Figure 2:
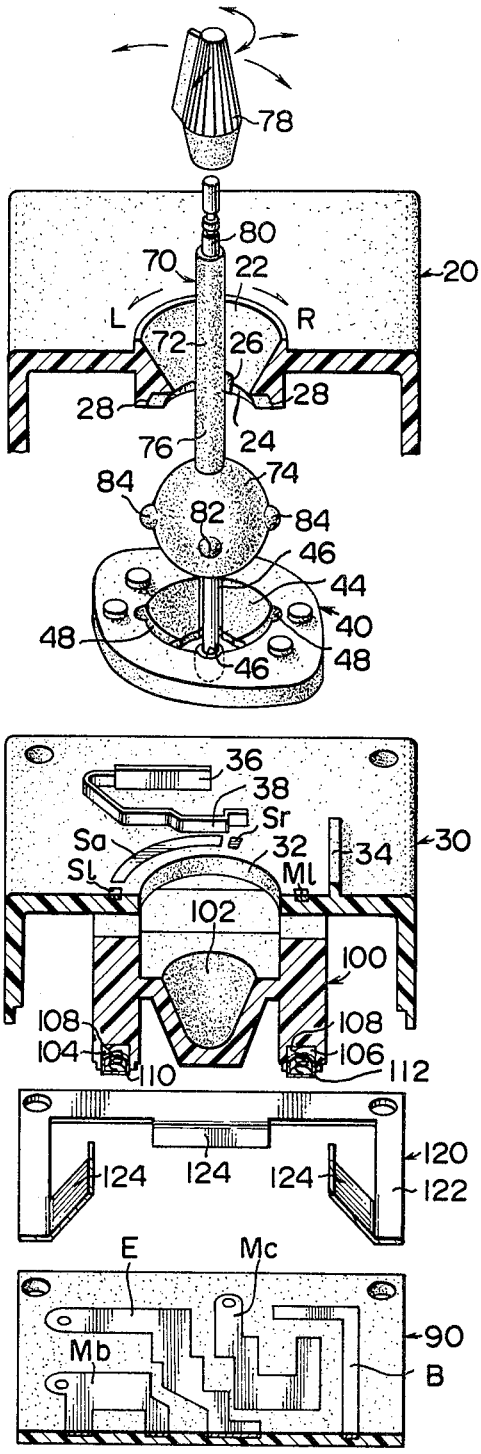
FIG. 2 is an exploded perspective view of the control switching device shown in FIG. 1.

The top wall of the upper housing 20 is provided at its center with an integral cylindrical block which extends perpendicularly inward from the top wall and has in it a conical hole 22 and a part-spherical portion 24 as better shown in FIG. 2 having a part-spherical inner surface contiguous to the lower edge of the hole 22. The ball-receiving portion 24 and the conical hole 22 are in alignment with the axis of the cylindrical block. Two pairs of arc grooves 26 and 28 are formed along the spherical inner surface of the ball-receiving portion 24 and these four grooves are angularly spaced apart from each other by 90° around the axis of the hole 22.

Figure 3:
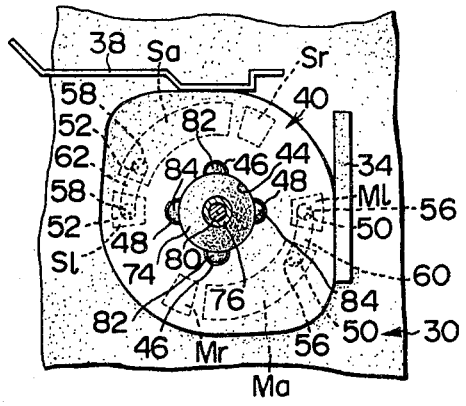
FIG. 3 is a fragmentary top plan view schematically illustrating the disk member incorporated in the device of FIGS. 1 and 2.

A circular hole 32 is formed in the center of the top wall of the lower housing, on which wall a bearing member 40 is disposed so that it is able to rotate around the central axis of said hole with its short column portion 42 provided on its lower side being snugly received in the circular hole 22. The bearing member 40 further has a part-spherical concave portion 44 in its center which co-operates with the part-spherical portion 24 so as to define a substantially hollow sphere between them. Two pairs of guide grooves 46 and 48 are formed along the inner surface of the part-spherical portion 44 and these grooves are angularly spaced apart from one another by 90°. As is best shown in FIGS. 1 and 3, the bearing member 40 has two pairs of recesses 50 and 52 in its lower surface, one pair being angularly spaced apart by 180° from the other around the axis of the bearing member. The recesses 50 and 52 open downwards and slidably receive therein cup-like electrical contact elements 56 and 58, respectively, each of these elements being biased downwards towards the top wall of the lower housing 30 by a compression coil spring 54. The two contact elements 56 are electrically connected to one another by an arc-shaped electrical conductor 60, and the two contact elements 58 are likewise connected together by an arc-shaped electrical conductor 62, as shown by the dotted lines in FIG. 3.

As is also shown by the dotted lines in FIG. 3, on the upper surface of the top wall of the lower housing 30 are provided an arcuate electrical contact plate Ma, right and left contact plates Mr and Ml arranged close to the opposite ends of and along the same circle as the plate Ma, a similar arcuate electrical contact plate Sa, and right and left contact plates Sr and Sl arranged close to the opposite ends of and along the same circle as the plate Sa and as the plate Ma, said circle being centered at the vertical axis of the lower housing 30. When the bearing member 40 is rotated counterclockwise as viewed and shown in FIG. 3 (the left position), so as to adjust the left hand mirror, the contact plates Ma and Ml are electrically connected together by the contact elements 56 and the conductor 60, and the contact plates Sa and Sl are connected together by the contact elements 58 and the conductor 62. When on the other hand the bearing member 40 is rotated clockwise, as viewed in FIG. 3 (to the right position) so as to adjust the right hand mirror, the contact plates Ma and Mr are connected with each other by the contact elements 56 and the conductor 60, and the contact plates Sa and Sr are connected with each other by the contact elements 58 and the conductor 62. Thus the bearing member 40 co-operates with the top wall of the lower housing 30 so as to provide a first switch means. In the example of a control system described later this first switch means is used for switching over the control function of the second switch means, which will be described hereafter, between the left and the right hand adjusting motors and solenoids.

The bearing member 40 has an oval shape, and is rotatable through 90° between its right and left positions which are established by a stop 34 which projects upwards from the top wall of the lower housing 30 so as to engage the peripheral surface of the bearing member 40. As seen in FIG. 2, a U-shaped leaf spring 38 is fixedly supported at its one end by a spring support 36 integrally provided on the top of the lower housing 30, and is resiliently engaged with the periphery of the bearing member 40 so that it produces a snapping action when the member 40 is rotated between the right and the left positions, thereby enabling the operator to feel the transfer between the two positions, and so that the member 40 is positively held in the one or the other position.

A switch actuating lever assembly 70 is pivotably supported by the co-operation of the bearing member 40 and the lower cylindrical projection of the upper housing 20. The lever assembly comprises an outer body formed of a synthetic resin or the like which has a tubular portion 72 and a ball-like portion 74 integral therewith, a core metal rod member 80 which extends through the outer body for the purpose of reinforcement, a knob 78 at its upper end, and a control element 86 at its lower extremity, all of which are fixedly secured to each other. The ball-like portion 74 is received in the hollow part-sphere defined by the part-spherical portion 24 formed in the upper housing 20 and the part-spherical portion 44 formed in the bearing member 40. The ball-like portion 74 has on its central periphery, i.e., its equator, two pairs of projections 82 and 84 which are angularly spaced 90° apart from one another around the axis of the assembly 70. The projections 82 lie in the grooves 46, and the projections 84 lie in the grooves 48. When the bearing member 40 is in the left position, as seen in FIG. 2 or 3, the projections 82 and the grooves 46 abut the grooves 26, and the projections 84 and the grooves 48 abut the grooves 28. However, when on the other hand the bearing member 40 is in the right position and is turned 90° clockwise as seen in FIG. 3, it will be clear that the projections 82 and grooves 46 will abut the grooves 28, and the projections 84 and the grooves 48 will abut the grooves 26.

The purpose of these grooves is as follows. When the bearing member 40 is in the left position and the lever assembly 70 is in the upright position, as seen in FIG. 2, all of the projections 82 and 84 lie completely in the grooves 46 and 48, and do not engage the grooves 26 and 28, and therefore by twisting of the knob 78 in the clockwise direction the disk member 40 may be shifted to the right position; and conversely. Now, if the knob 78 of the lever assembly 70 is shifted forwards and backwards as seen in FIG. 2, it will pivot about the axis of the projections 84, and the projections 82 will move up and down in the grooves 46. If the lever is moved sufficiently far, one of the projections 82 will come out of its groove 46 upwards and engages one of the grooves 26 so as now to prohibit twisting of the lever. Similarly, if the knob 78 of the lever assembly 70 is shifted sideways as seen in FIG. 2, it will pivot about the axis of the projections 82 , and the projections 84 will move up and down in the grooves 48. If the shifting of the lever assembly 70 proceeds sufficiently far, one of the projections 84 will come out of its groove 48 upwards and engages one of the grooves 28 so as again to prohibit twisting of the lever. Such interlocks are generally desirable in order to avoid damaging of the control system due to improper mixed operations of the complex switches.

In this connection, it will be noted that, in the embodiment illustrated, the grooves 26, 28 and 46, 48 are formed of approximately the same width as the projections 82, 84 along their entire length. Therefore it will be possible to tilt the lever assembly 70 forwards and backwards around the axis of the projections 84, or leftwards and rightwards around the axis of the projections 82 as viewed in FIG. 2, but it will not be possible to perform both these tilting movements simultaneously, because of the limitations imposed by solid geometry. However, it will be apparent that, in order to be able to combine these tilting movements, the grooves 26, 28 and 46, 48 may be somewhat wider than the projections 82 and 84, or, more desirably, they may be widened out upwards and downwards of the position which corresponds to the location of the projections 82, 84 when the lever assembly 70 is in the upright position, at an angle approximately equal to the maximum angle through which the lever assembly 70 can be tilted. Such a formation for the grooves 26, 28 and 46, 48 as described above is envisaged as another possible embodiment of the present invention. By such an arrangement it is possible to provide other switching positions in addition to the up-and-down and left-to-right switching positions so that, for instance, the lever may also be tilted in two diagonal directions in order to effect other switching operations.

The arrangements of the lower switch means will now be described. The lower housing 30 has an open bottom closed by a bottom plate 90 made of an electrically insulating material such as synthetic resin. On this plate a sliding member 100 is movably supported, and this member is the moving member of the second switch means. This member 100 is cuboid in shape, and in its center it has a conical hole 102 facing upwards which has a spherical inner surface at its bottom. This hole 102 receives the control element 86 attached to the lower extremity of the lever assembly 70, which control element has a spherical outer surface corresponding to the spherical inner surface of the bottom of the hole 102. Therefore tilting movement of the lever assembly 70 causes the sliding member 100 to move forwards and backwards, or leftwards and rightwards, as viewed in FIG. 2. A spring element 120 is mounted on the bottom plate 90 by the bolts 12. This spring element 120 comprises a rectangular frame portion 122 which is disposed along outer edges of the bottom plate 90, and cantilever leaf spring portions 124 integral with the frame portion which extend inwardly and upwardly from it. These spring portions 124 engage the sides of the cuboid sliding member 100 so that it is resiliently maintained in its center position, and also so that it is inhibited from rotating, i.e. so that it only performs translational movement, and does not rotate about its vertical axis. On the sliding member 100, on its upper and lower surfaces, are protuberances 118 and 119, which engage with the lower surface of the top wall of the lower housing 30, and the upper surface of the bottom plate 90, respectively, so as to facilitate the sliding movement of the member 100 over the plate 90, with relatively small frictional force being created therebetween. In another embodiment, it would be possible to provide guiding grooves to receive these projections 118 and/or 119, and such grooves would more positively prevent any turning of the sliding member 100 about its vertical axis, thus reinforcing the action of the springs 124.

Figure 4:
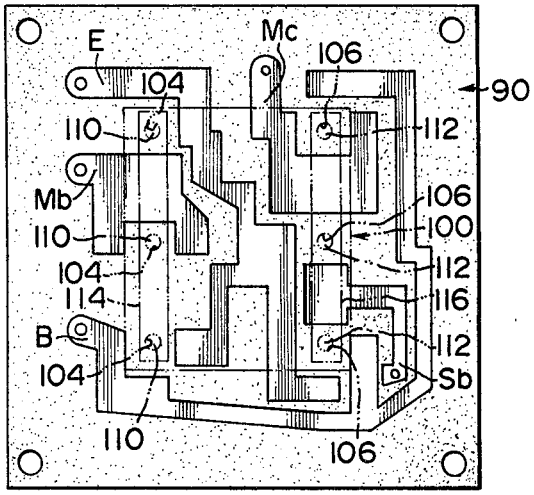
FIG. 4 is a top plan view of a bottom plate incorporated in the device, for illustrating contact plates thereon.

As shown in FIGS. 1, 2, and 4, the sliding member 100 has in its bottom surface three recesses 104 along the left edge and three recesses 106 along the right edge. These recesses all open downwards, towards the upper surface of the bottom plate 90, and receive cup-like electrical contact elements 110 and 112, respectively, each of which is biased downwards, towards the upper surface of the bottom plate 90, by a spring 108. As shown in phantom lines in FIG. 4, the contact elements 110 are electrically connected with each other by an electrical conductor 114, while the elements 112 are connected with each other by a conductor 116.

As is best shown in FIG. 4, the bottom plate 90 has thereon contact plates B, E, Mb, Mc, and Sb of a complex form. These contact plates are arranged so that when the sliding member 100 is in its central position none of them is connected to any other by the combination of contact elements 110 and conductor 114 or by the combination of contact elements 112 and conductor 116. However, when the sliding member 100 is moved away from its center position to any of the four other positions envisaged for it, the plates are connected together according to the following table:

TABLE

ELECTRICAL CONNECTIONS BETWEEN THE CONTACT PLATES

| Lever tilting direction | Sliding member position | Contact element and conductor | Contact plates B | E | Mb | Mc | Sb |
|---|---|---|---|---|---|---|---|
| Neutral | Center | 110 & 114 | X | X | X | X | X |
| | | 112 & 116 | X | X | X | X | X |
| Up | Lower | 110 & 114 | C | X | C | X | X |
| | | 112 & 116 | X | C | X | C | C |
| Down | Upper | 110 & 114 | X | C | C | X | X |
| | | 112 & 116 | C | X | X | C | C |
| Left | Right | 110 & 114 | X | C | C | X | X |
| | | 112 & 116 | C | X | X | C | X |
| Right | Left | 110 & 114 | C | X | C | X | X |
| | | 112 & 116 | X | C | X | C | X |

Wherein, in each row, "C" shows that the conductors so designated are connected together, while "X" shows that the conductors so designated are isolated.

For example, if the knob of the lever assembly 70 is tilted upwards or forward as viewed in FIG. 2, thereby causing the sliding member 100 to move to its lower operational position, the contact plates B and Mb are connected to each other by the combination of the contact elements 110 and the conductor 114, and the contact plates E, Mc, and Sb are connected with each other by the combination of the contact elements 112 and the conductor 116.

It will be easily understood that in an alternative embodiment in which combined tilting of the lever in the two possible tilt directions was also possible, as outlined above with respect to the construction of the grooves 26, 28 and 46, 48, a corresponding sliding member 100 would have nine positions instead of the five of the present embodiment, and therefore a different set of contact plates, and possibly of sliding contact members similar to the elements 110 and 112, would have to be provided. A person skilled in switch design can easily envisage many operational arrangements which could be used for such a switch.

Figure 5:
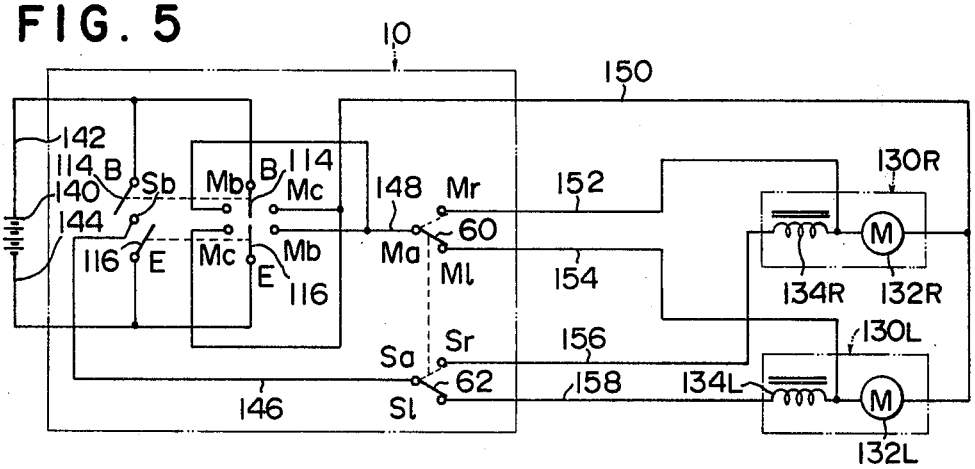
FIG. 5 is a schematic diagram of the electric circuits incorporating the control switching device of this embodiment of the present invention, including right and left actuating units for remotely controlling two power outside mirrors of an automobile.

In the present embodiment the first switch means, comprising the bearing member 40, is connected to the second switch means, comprising the sliding member 100, by wires which may be internal or external to the switch body itself, and in any event logically are to be considered part of the control switching device 10. FIG. 5 shows an electrical circuit which connects the first switch means to the second switch means of the switching device 10 confined by the two-dotted line indicated by the reference numeral 10 in FIG. 5, and further shows an electrical control system for controlling right and left actuating units which remotely power-control the outside mirrors of the automobile, which units are designated by 130R and 130L. Each of these well-known actuating units comprises a DC motor 132R or 132L, an electromagnetic clutch (not shown) comprising a solenoid means 134R or 134L (which is shown), and an actuating mechanism (not shown) which receives rotational drive from the motor via the electromagnetic clutch, thereby adjusting the position of the mirror. This actuating mechanism turns the mirror up or down by forward or reverse rotation of the DC motor, when the solenoid means is actuated so as to operate the electromagnetic clutch, while it turns the mirror right or left by forward or reverse rotation of the DC motor, when the solenoid means is not actuated and therefore the electromagnetic clutch is not operated. The connections of the contact plates B, E to the battery 140 of the automobile by lines 142 and 144, of the contact plate Sb to the contact plate Sa by line 146, of the contact plate Mb to the contact plate Ma by line 148, of the contact plate Mc with one terminal of the motors 132R and 132L by line 150, of the contact plate Mr with the other terminal of the motor 132R and with one terminal of the solenoid means 134R by line 152, of the contact plate Ml with the other terminal of the motor 132L and with one terminal of the solenoid means 134L by line 154, of the contact plate Sr with the other terminal of the solenoid means 134R by line 156, and of the contact plate Sl with the other terminal of the solenoid means 134L by line 158, are clearly shown.

The operation of the device should now be clear to one skilled in the art, but for the sake of absolute clarity it will now be briefly described with respect to an example. The operator first twists the lever assembly 70 about its long axis while maintaining it in the neutral or center position, so as to select the electric circuit for adjusting the right or the left hand mirror, as he desires. Then he tilts the lever assembly upwards or downwards, or leftwards or rightwards, (provided that the switch 10 is so mounted that the lever projects horizontally towards him), to adjust the mirror as he wishes.

For example, in order to turn upwards the right-hand mirror, the operator first grips the knob 78 of the lever assembly 70 and rotates it clockwise as far as possible, while maintaining its tilt position in the center or neutral position. This rotates the bearing member 40 so as to select the circuit for adjusting the right hand mirror, by connecting the contact plate Ma with the contact plate Mr via the contact elements 56 and the conductor 60, and by connecting the contact plate Sa with the contact plate Sr by the contact elements 58 and the conductor 62. Then the operator moves the knob upwards, which causes the sliding member 100 to move downward as seen in FIG. 4 to its lower operational position. Therefore, the contact plate B is electrically connected with the contact plate Mb by the contact elements 110 and the conductor 114, and the contact plate E is connected with the contact plates Mc and Sb by the contact elements 112 and the conductor 116. These connections actuate the DC motor 132R and the solenoid means 134R in the right-hand actuating unit 130R, and this, as explained above, turns the right-hand mirror upwards.

As will be appreciated from the foregoing description, the embodiment outlined above uses the operation of the first switch means to switch over, or to modify, the operation of the second switch means, so that the second switch means may control one or another of a plurality of similar devices. This is performed very neatly and compactly by the use of a single switching device which has only one control knob.

It will be easily understood by one skilled in the art that various modifications could be made to the form and the detail of the invention without departing from its scope. For instance, in an embodiment closely similar to the one above, the first switching device comprising the bearing member 40 could be arranged to have more than two positions—for instance, to have three positions, i.e., neutral, left, and right turn positions. Then three different devices which had the same control operation could be controlled alternatively, by using the first switching device to switch the operation of the second switching device between their control inputs, in a manner analogous to that explained above.

Further, it is not essential to the essence of the present invention that either of the electrical controlling devices controlled should be a switch having a finite number of possible positions. For instance, the first electrical controlling device could be a variable resistor having a continuous range of control settings. Also, in principle, the second electrical controlling device, which is controlled by the tilting movement of the lever about the two tilt axes, could be some device with a continuously two-dimensional range of settings—for instance, a combination of two variable resistors operating in crossed directions. The essence of the present invention is the fact that one of the electrical controlling devices is actuated by twisting of the control lever about its long axis, while the other electrical control device is actuated by tilting of the lever about either or both of the tilt axes.

Therefore, since various modifications of the details of the invention are possible without departing from its scope or spirit, it is desired that the protection granted should not be limited by any details of the embodiment illustrated, or of the drawings, which have been given for illustration only, but solely by the appended claims.

We claim:

1. An electrical controlling device, comprising:

a housing having first and second plate portions arranged in parallel to one another, said first plate portion being formed with a central opening;

a rotary switch assembly having stationary contact elements mounted on said first plate portion, a movable bearing member engaged in said central opening so as to be rotatable around its central axis, and movable contact elements supported by said movable bearing member so as to cooperate with said stationary contact elements;

an actuating lever having a bearing portion at a middle portion thereof and movably coupled to said housing with said bearing portion being received in said bearing member so as to be tiltable but not rotatable relative to said bearing member, said actuating lever further having one end projecting from said housing which is adapted to be gripped by the hand of an operator for twisting and tilting operation and the other end extending toward said second plate portion;

a sliding switch assembly having stationary contact elements mounted on said second plate portion, a sliding member, and movable contact elements supported by said sliding member so as to cooperate with said stationary contact elements mounted on said second plate portion, said sliding member receiving said other end of said actuating lever so that said sliding member is slidingly driven by said actuating lever when it is tilted; and a stop which allows said sliding member to slide on said second plate portion and restrains said sliding member from rotating on said second plate portion.

2. The device of claim 1 wherein said sliding member includes a central hole and said central hole receives said other end of said actuating lever.

3. The device of claim 2 wherein said stop comprises spring means for resiliently allowing said sliding member to slide on said second plate portion and for restraining said sliding member from rotating on said second plate portion.

4. The device of claim 3, wherein said bearing member has a part-spherical inner surface with two pairs of guide grooves formed therealong as angularly spaced apart from one another by 90°, and said bearing portion of said actuating lever has at least at a portion thereof a part-spherical outer surface which slidably engages said part-spherical inner surface of said bearing member, and two pairs of projections projecting from said part-spherical outer surface and adapted to engage said guide grooves.

5. The device of claim 4, wherein said bearing member has a side edge portion which includes an arc portion of 90° and two straight portions extending from opposite ends of said arc portion with an angle of 90° therebetween, and said housing has a straight stop which engages said straight portions of said side edge portion so as to restrict rotation of said bearing member within 90°.

6. The device of any one of claims 1, 2, 3, 4, or 5, wherein said sliding member has a rectangular side edge, and said spring means has two pairs of spring plates, those of each pair having tip ends arranged in parallel to one another and engaging a pair of opposite straight edge portions of said sliding members.

* * * * *